US005765307A

United States Patent [19]

Grimes

[11] Patent Number: 5,765,307

[45] Date of Patent: Jun. 16, 1998

[54] WINDOW BLIND SYSTEMS

[76] Inventor: Ronald R. Grimes, 240 S. 850 East, Provo, Utah 84606

[21] Appl. No.: 710,737

[22] Filed: Sep. 20, 1996

[51] Int. Cl.[6] ..... E06B 7/086

[52] U.S. Cl. ..... 49/77.1; 40/503

[58] Field of Search ..... 49/77.1, 74.1, 49/87.1; 40/503; 160/115, 113, 179, 180, 176.1 V, 168.1 V, 900

[56] References Cited

U.S. PATENT DOCUMENTS

| | | | |
|---|---|---|---|
| 1,639,474 | 8/1927 | Whitmore . | |
| 2,103,788 | 12/1937 | Mohrfeld . | |
| 3,012,294 | 12/1961 | Waldor . | |
| 3,196,895 | 7/1965 | Dayus | 49/77.1 X |
| 3,495,521 | 2/1970 | Foste | 49/77.1 X |
| 4,021,946 | 5/1977 | Bradshaw | 40/504 X |
| 4,103,601 | 8/1978 | Dayus | 49/77.1 X |
| 4,493,342 | 1/1985 | Bachman | 49/77.1 X |
| 4,993,469 | 2/1991 | Moench | 160/168.1 |
| 5,119,868 | 6/1992 | Werner | 160/115 |
| 5,203,394 | 4/1993 | Hailey | 160/166.1 |
| 5,271,447 | 12/1993 | Aronovich | 160/236 |
| 5,303,760 | 4/1994 | Perez | 160/236 |

FOREIGN PATENT DOCUMENTS

| | | |
|---|---|---|
| 1293168 | 4/1962 | France . |
| 814563 | 9/1951 | Germany . |
| 2041513 | 9/1980 | United Kingdom . |

*Primary Examiner*—Blair Johnson
*Attorney, Agent, or Firm*—Workman, Nydegger & Seeley

[57] ABSTRACT

A compact blind system capable of controlling the amount of light, heat or air flow entering a room by means of multiple, independent slat systems. The slats can work either in combination or independently with each other and can be fit either inside multi-pane glass windows or doors or simply used with existing openings.

4 Claims, 6 Drawing Sheets

WINDOW BLIND SYSTEMS

BACKGROUND OF THE INVENTION

1. The Field of the Invention

The present invention relates to compact blind systems capable of controlling the amount of light, heat or even air flow entering a room by means of multiple, independent sets of panels which can work either in combination or independently with each other and can be fit either inside multi-pane glass windows or doors or simply used with existing openings.

2. Description of the Prior Art

The use of both vertical and horizontal slats to control the amount of light entering a room through a window or door is well known. Multiple improvements on the Venetian blind as well as its vertical counterparts have been developed through this century.

For example Whitmore (U.S. Pat. No. 1,639,474) teaches the use of slats for Venetian blind with one slat surface being light reflective and the other light absorbing. More recent improvements such as Moench (U.S. Pat. No. 4,993,469) maintain a desired distance between the slats as they are moved from their closed to their open position. Still others, such as Aronovich (U.S. Pat. No. 5,271,447) and Peres (U.S. Pat. No. 5,303,760) concerned with slat appearance, teach a means for modifying the appearance of a given set of blinds.

All of these inventions use a single set of slats which can either be opened, parallel to incoming light, or closed by rotating the slats perpendicular to the incoming light. Typically, either of the slats' two sides can be rotated to face out and depending on the slat shape and light absorption or reflection, different amounts of light and heat can be absorbed, reflected and blocked. Because of the width of a given slat, the use of multiple slat systems capable of simultaneous light and heat control have not been practically possible.

SUMMARY AND OBJECTS OF THE INVENTION

Accordingly, an object of the present invention is to provide a blind system capable of employing multiple sets of panels capable of working independently or in combination with each other.

Another object of the present invention is to provide a blind slat system employing panels of slats which fold on themselves so than when opened their total width is a fraction of the area covered when closed, therefore increasing the viewable area between the slats.

Yet another object of the present invention is to provide a blind system capable of a wide range of light and heat control.

It is a further object of the present invention to provide a blind system capable of showing multiple panoramic visual displays.

It is a further object of the present invention to provide a blind system with all the advantages as described which can be installed between panes of glass as well as into existing openings.

In one embodiment of the present invention, these and other objects are achieved by using an assembly that comprises two sets of panels in the same plane, each with its own independent rotation mechanism for opening and closing the slats. This allows for each of the two sets of panels to provide a different amount of light control, or two different panoramic views, if desired, while still providing the ability to open both sets of blinds and see out of the window. This means that a set of panels in a window can provide, for example, a light panoramic view and then a dark block of nearly all incoming light followed by opening the system to see outside.

The two sets of panels each rotate a panel of slats independently around a set point. This allows for one set of panels to be opened and the second set of panels to be either open or closed. These sets of panels can comprise any number of panels formed by any number of slats and practically will be between one and three slats. For two sets of panels, having one slat per panel, both sets of panels will rotate its given panels around the same point. For multi-slat sets of panels, each panel will be rotated about different points.

A slide and rotating mechanism will produce the necessary 90° rotational force at both ends of the slats. This 90° rotation rotates the slats from a closed position where the slats are perpendicular to, and thereby blocking, incoming light to an opened position where the slats are parallel to the incoming light.

If even greater light control is desired, a second assembly comprising two sets of panels can be placed in parallel with the first assembly. This second assembly can provide the light control, while the first assembly provides two different panoramic views depending on the desired effect.

These advantages together with other objects and advantages which will become subsequently apparent reside in the details of construction and operation as more fully hereinafter described and claimed, reference being had to the accompanying drawings forming a part hereof.

Additional objects and advantages of the invention will be set forth in the description which follows, and in part will be obvious from the description, or may be learned by the practice of the invention. The objects and advantages of the invention may is be realized and obtained by means of the instruments and combinations particularly pointed out in the appended claims.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
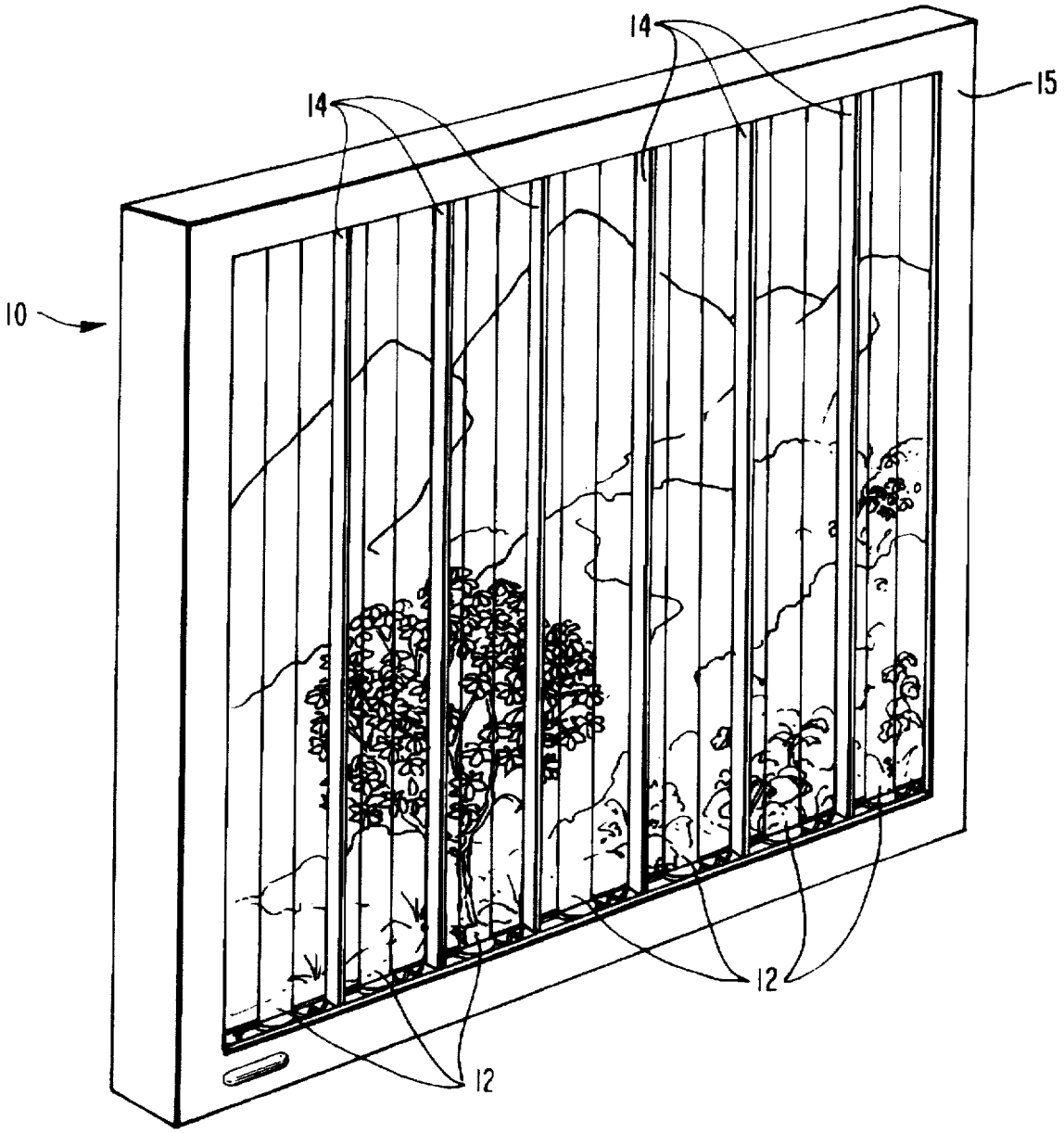
FIG. 1 is a perspective view of a window containing a blind system with two independent sets of slats.

FIG. 1 shows a window blind system 10 which consists of an assembly that includes two sets of panels of slats, set A whose panels of slats are closed 12, and set B whose panels of slats are open 14. These two sets of panels of slats are supported inside a window frame 15. The preferred embodiments will describe a blind system for a window, those skilled in the art will recognize this system to be equally well adapted to doors or any other opening where light or heat are to be controlled. Additionally, while the following discussion will specifically deal with vertical blinds, the present invention is equally applicable to horizontal blind systems. The description of horizontal blinds would only differ from the following description of vertical blinds in that the horizontal blinds would replace the top and bottom references on the vertical blinds with left, and right for the horizontal blinds and would also replace the left and right references on the vertical blinds with top and bottom for the horizontal blinds.

Figure 2:
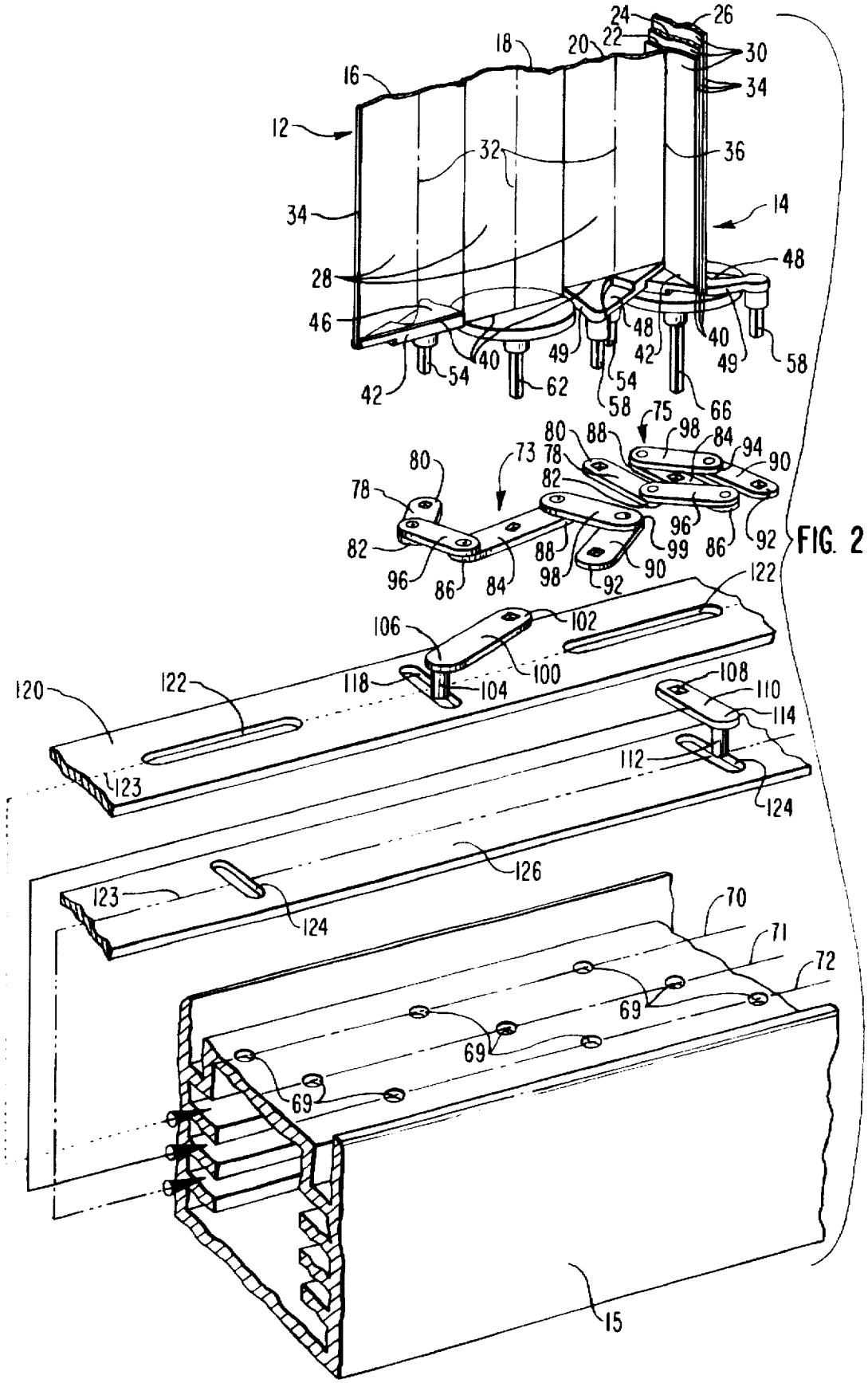
FIG. 2 is an exploded, perspective view of the bottom parts in a blind system with; two independent sets of panels of slats.

FIG. 2 shows one embodiment of the panels of the two independent sets of panels of slats, set A 12, and set B 14, which each operate independent of each other. A panel of set A contains a left slat 16, a center slat 18 and a right slat 20. A panel of set B similarly contains a left slat 22, a center slat 24 and a right slat 26. Each slat contains two opposing substantially planer faces, a front face 28, and a back face 30, which outline a generally rectangular shape. The slats naturally also contain a longitudinal axis 32 along with two opposing sides a left side 34 and a right side 36 which are parallel to the longitudinal axis and two opposing ends, a top end 38, shown in FIG. 3, and a bottom end 40, shown in FIG. 2, which are perpendicular to the longitudinal axis. This system will work equally well and is intended to cover embodiment where, for example in panels of set A the center slat is connected to the left slat and to the right slat, as well as the embodiment where all three slats are completely separate.

These sets of panels of slats can either be opened or closed. A panel from set B 14 is shown as being open. The slats of the panel of set B are turned such that front face 28 of left slat 22 is placed in contact with back face 30 of center slat 24, and front face 28 of center slat 24 is placed in contact with back face 30 of right slat 26. Each panel is parallel to incoming light with each of the slats of the panel rotated, folded or turned onto each other at a fixed point for opening, in this case the longitudinal axis 32 of center slat 24. A panel from set A 12 is shown as a closed set of slats which are perpendicular to and therefore block light, heat, air flow, etc. FIG. 2 shows how the right side 36 of set A's panel with right slat 20 will touch up against the back face of set B's panels parallel and closed left slat 22. It would then be obvious that for a system containing a plurality of alternated sets of panels A and B the left side 34 of set A's panel with left slat 16 would also touch up against the front face of set B's panel with right slat 26. Similarly when set A panels of set A are is open and its slats are all rotated, folded or turned onto each other at a set point, the center slat's longitudinal axis 44 in this embodiment, set B can close with the left side 34 of set B's panel with 22 left slat touching up against set A's panels with parallel right slat 22 and right side 36 of set B's with right slat 26 touching up against set A's panels with closed left slat 22.

It should be clear that set A 12 can be either open or closed while set B 14 is open and set B 14 can be either open or closed while set A 12 is open. This means that while both sets of panels may be simultaneously open, only one set of panels can be closed at a time. When both sets of panels are opened the distance between the opened panels, or viewable area, will be bigger than the viewable area between slats and blinds in traditional blind systems containing only one set of slats.

Figure 3:
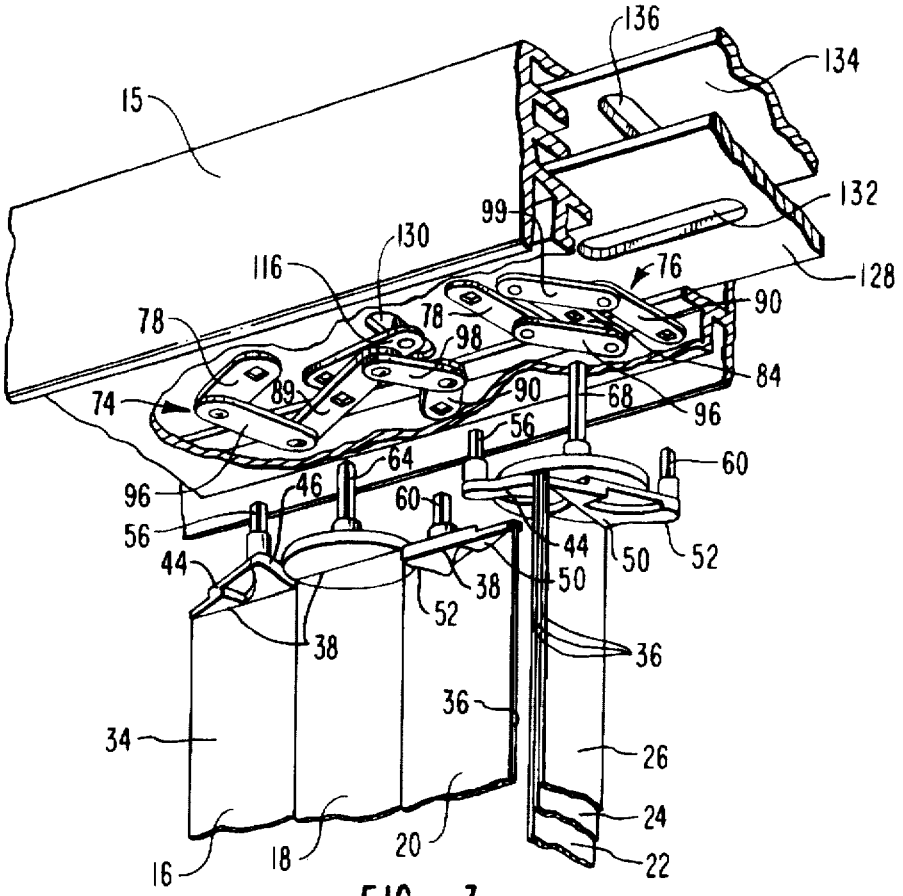
FIG. 3 is a cut away, perspective view of the top parts in a blind system with two independent sets of panels of slats.

Left slats 16 and 22 for sets A 12 and B 14, respectively, have a bottom left slat arm 42 connected to bottom end 40 and a top left slat arm 44 connected to top end 38, respectively. These slat arms are shown in FIGS. 2 and 3 as 60° right triangular shaped pieces, and while the exact shape is not important, the 60° right triangle teaches an important characteristic of the slat arm. In a 60° right triangle the side adjacent to the 60° is equal in length to ½ that of the side hypotenuse of the triangle. The width of front face 28, which extends from left edge 34 to right edge 36, defines the hypotenuse of the 60° angle of the triangular piece. The tip of the 60° triangular piece also defines the pivotal point of the triangular piece and center of left slat pin 54. The slat arm extension 46 which is both adjacent and perpendicular to bottom left slat 16 is also adjacent to the 60° angle and pivot point of the triangular shaped slat arm 42 and is equal in length to ½ of width 28 of left slat 16. Similarly the bottom and top of both set A's panel with right slat 20 and set B's panels with right slat 26 are attached to bottom right slat arms 48 and top right slat arms 50. Both the bottom and top right slat arms include extensions 49 and 52 respectively, the length of which are each equal to ½ that of right slat face width 28.

A bottom left slat pin 54 extends down from the pivotal end of extension 46 of the bottom left slat arm 42 just as a top left slat pin 56 extends up from the pivotal end of extension 46 of the top left slat arm 44. A bottom right slat pin 58 extends down from the pivotal end of extension 49 of the bottom right slat arm 48 just as a top right slat pin 60 extends up from the pivotal end of extension 52 of the top right slat arm 50. Unlike the left and right slat pins which are identical for panels of both set A and set B, the center slat pins 66 for panels of set B are longer than the center slat pins 62 for panels of set A, although both are longer than the right and left slat pins. These center slat pins, which extend from longitudinal axis 32 of the center slats 18 and 24, define the fixed point about which each set of slats panels of slate rotate. For set A, the bottom center slat pin extends down from longitudinal axis 32 of center slat 18 just as the top center slat pin extends upward in the same fashion from the longitudinal axis of the center. For set B, a bottom center slat pin 66 extends down from longitudinal axis 32 of center slat 24 just as a top center slat pin 68 extends upward in the same fashion from the longitudinal axis of set B's center slat. The slat pins for all the slats extend through support holes 69 in both the top and the bottom of frame 15. As can be seen in FIG. 2, the support holes for the right slat pins of both set A and B are arranged in a line 70. Similarly the support holes for the center slat pins of both set A and B also form a line 71, parallel to the line for the right slat pins, and the support holes for the left slat pins form a line 72 which is also parallel to the line for the right and center slat pins.

The action of opening and closing panels of set A 12 is accomplished by means of a bottom opening mechanism 73, shown in FIG. 2 and contained inside frame 15, and a top opening mechanism 74, shown in FIG. 3 which is also contained inside the frame. The action of opening and closing panels of set B 14 is accomplished by means of a bottom opening mechanism 75 and a top opening mechanism 76. All opening mechanisms contain a left rotator arm 78 with a pin end 80 and a connector end 82, a center rotator arm 84 with left end 86 and a right end 88 and a right rotator arm 90 with a pin end 92 and a connector end 94. The connector end of the left rotator arm is connected to the left end of the center rotator arm by a left connector arm 96 and the connector end of the right rotator arm is connected to the right end of the center rotator arm by a right connector arm 98.

Bottom left slat pin 54 of set A 12 is inserted through its support hole 69 in frame 15 and then attaches to pin end 80 of left rotator arm 78 of set A's bottom opening mechanism 73. Bottom right slat pin 58 of set A is inserted through its support hole in the frame and then attaches to pin end 92 of right rotator arm 90 of set A's bottom opening mechanism. Unlike the left and right slat pins which simply connect to the pin ends of their respective rotator arms, set A's bottom center slat pin 62, which is inserted through its support hole in the frame, extends through the center of center rotator arm 84 of set A's bottom opening mechanism and attaches to set A's bottom pivot arm 100 at the pivot arm's rotator end 102. A bottom pivot pin 104 also extends down from the pivot arm's pivot end 106. Attachment of set B 14 to its bottom opening mechanism 75 is identical to set A's attachment to its bottom opening mechanism 73. Set B's bottom center slat pin 66 extends to the rotator end 108 of bottom pivot arm 110 and the bottom pivot pin 112 extends down from the pivot arm's pivot end 114.

Identical attachment between the top slat pins and the top opening mechanisms will occur with set A's top center slat pin 64 attaching to set A's top pivot arm 116 and set B's top) center slat pin 68 attaching to set B's top pivot arm (not shown).

Bottom pivot pin 104 of set A 12 extends into a pivot slide slot 118 of a first bottom pivot slide 120. Center slat pin 66 of set B 14 extends through a center pin grove 122 which is formed along the first bottom pivot slide's longitudinal axis 123 as compared to the pivot slide slot which is perpendicular to the longitudinal axis. This center pin grove allows the center slat pin to remain unaffected by the movement of set A's first bottom pivot slide. Other variations where set B's bottom pivot pin 112 extended through the first bottom pivot slide are also well within the scope of the invention. Set B's bottom pivot pin 112 then extends into a pivot slide slot 124 of a second bottom pivot slide 126. The first and second bottom pivot slides as well as the bottom opening mechanisms are contained within frame 15 with any number of variations on the placement of the opening mechanisms, pivot arms and pivot slides possible.

FIG. 3 indicates that a mirror image of the bottom pivot pins interaction with the pivot slides exists at the top. A first top pivot slide 128 contains a pivot slide slot 130 for the top pivot pin of set A (not shown) as well as a center pin grove 132. A second top pivot slide 134 contains a pivot slide slot 136 for the top pivot pin of set B (also not shown). As with the bottom, the first and second top pivot slides as well as the top opening mechanisms are contained within frame 15 with any number of variations on the placement of the opening mechanisms, pivot arms and pivot slides possible.

Figure 4:
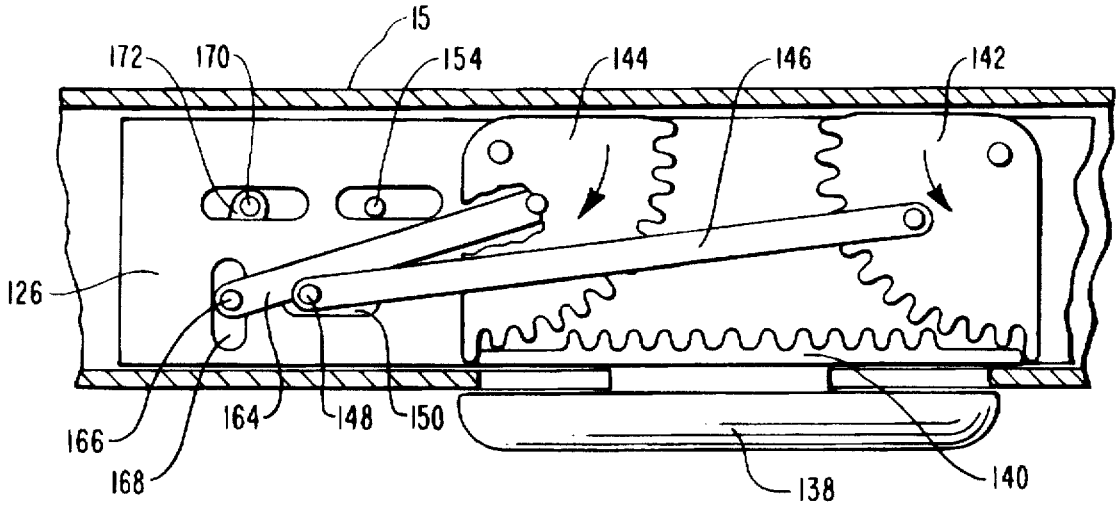
FIG. 4 is the bottom view of the actuation mechanism for opening and closing two independent sets of panels of slats.
Figure 5:
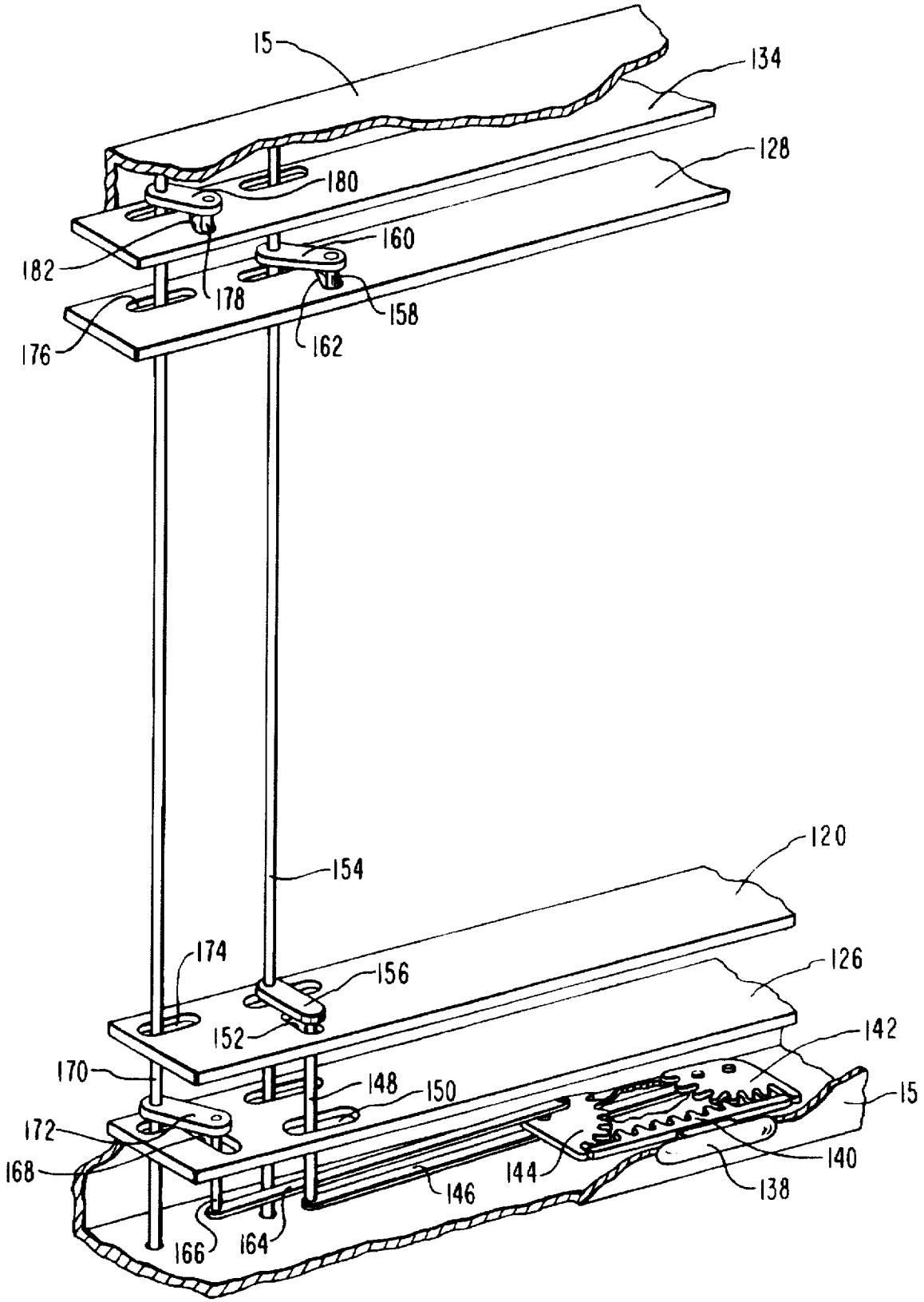
FIG. 5 is a cut away, perspective view of a means for transferring actuation from the bottom slides to the top slides.

FIGS. 4 and 5 show one example of a means for actuating the pivot slides. An actuator 138 which extends through frame 15 employs an engagement mechanism 140, which in this embodiment uses a rack of gear teeth. This engagement mechanism is capable of engaging either of two pivot slide actuation mechanisms 142, and 144, which in this embodiment are two partial gears which each fit the rack of gear teeth of the engagement mechanism. When the first pivot slide actuation mechanism 142 is engaged by the engagement mechanism of the actuator it is rotated in a counter clockwise direction. This movement is transferred by means of a first actuation transfer rod 146 which is connected to the first pivot slide actuation mechanism at one end and to a first pivot rod 148 at the other end. This first pivot rod extends through a pivot rod grove 150 in second bottom pivot slide 126 which is parallel to longitudinal axis 123. The first pivot rod then extends through a first pivot rod slot 152 in first bottom pivot slide 120 which is perpendicular to the longitudinal axis. As the first engagement mechanism rotates counter clockwise, the first actuation transfer rod moves with it as does the first pivot rod. The movement of the first pivot rod in the first pivot rod slot in turn moves the first bottom pivot slide. The first pivot rod is also connected to first bottom to top transfer rod 154, both ends of which are inserted into the frame so as to allow its rotation, by means of a connector 156. The movement of the first pivot rod turns the first bottom to top transfer rod in a counterclockwise direction. This motion, in turn is transferred to a first top pivot rod 158 by means of a connector 160. The first top pivot rod extends into a first top pivot slot 162, also perpendicular to the longitudinal axis, of first top pivot slide 128 thereby moving the first top pivot slide simultaneously with the first bottom pivot slide. This simultaneous motion of the first top and bottom slides is transmitted to the bottom and top center slat pins 62 and 64 which in turn actuate left top and bottom slats pins 54 and 56 as well as right top and bottom slat pins 60 and 58 to rotate slats 16, 18, and 20 in all panels of set A 12 simultaneously.

A structurally identical system transfers the clockwise motion of second pivot slide actuation mechanism 144 to second bottom pivot slide 126 and second top pivot slide 134. The clockwise movement produced when the second pivot slide actuation mechanism is engaged by engagement mechanism 140 of actuator 138, is transferred to a second actuation transfer rod 164. The second actuation transfer rod is connected to the second pivot slide actuation mechanism at one end and to a second pivot rod 166 at the other end. This second bottom pivot rod extends through a second pivot rod slot 168 in second bottom pivot slide 126 which is perpendicular to longitudinal axis 123. The second bottom pivot rod is also connected to a second bottom to top transfer rod 170, both ends of which are inserted into the frame so as to allow its rotation by means of a connector 172. The second bottom to top transfer rod extends through a bottom transfer groove 174 which is parallel to the longitudinal axis of first bottom pivot slide 120 and a top transfer groove 176 which is parallel to the longitudinal axis of first top pivot slide 128. The movement of the second pivot rod turns the second bottom to top transfer rod in a clockwise direction. This motion, in turn is transferred to a second top pivot rod 178 by means of a connector 180. The second top pivot rod extends into a second top pivot slot 182, perpendicular to the longitudinal axis of second top pivot slide 134 thereby moving the second top pivot slide simultaneously with the second bottom pivot slide.

While this embodiment demonstrates a means for actuating both slides with one mechanism, a less sophisticated mechanism employing a mechanism for each slide is within the scope of the present invention as are other mechanisms capable of actuating both slides with a single mechanism.

Figure 6:
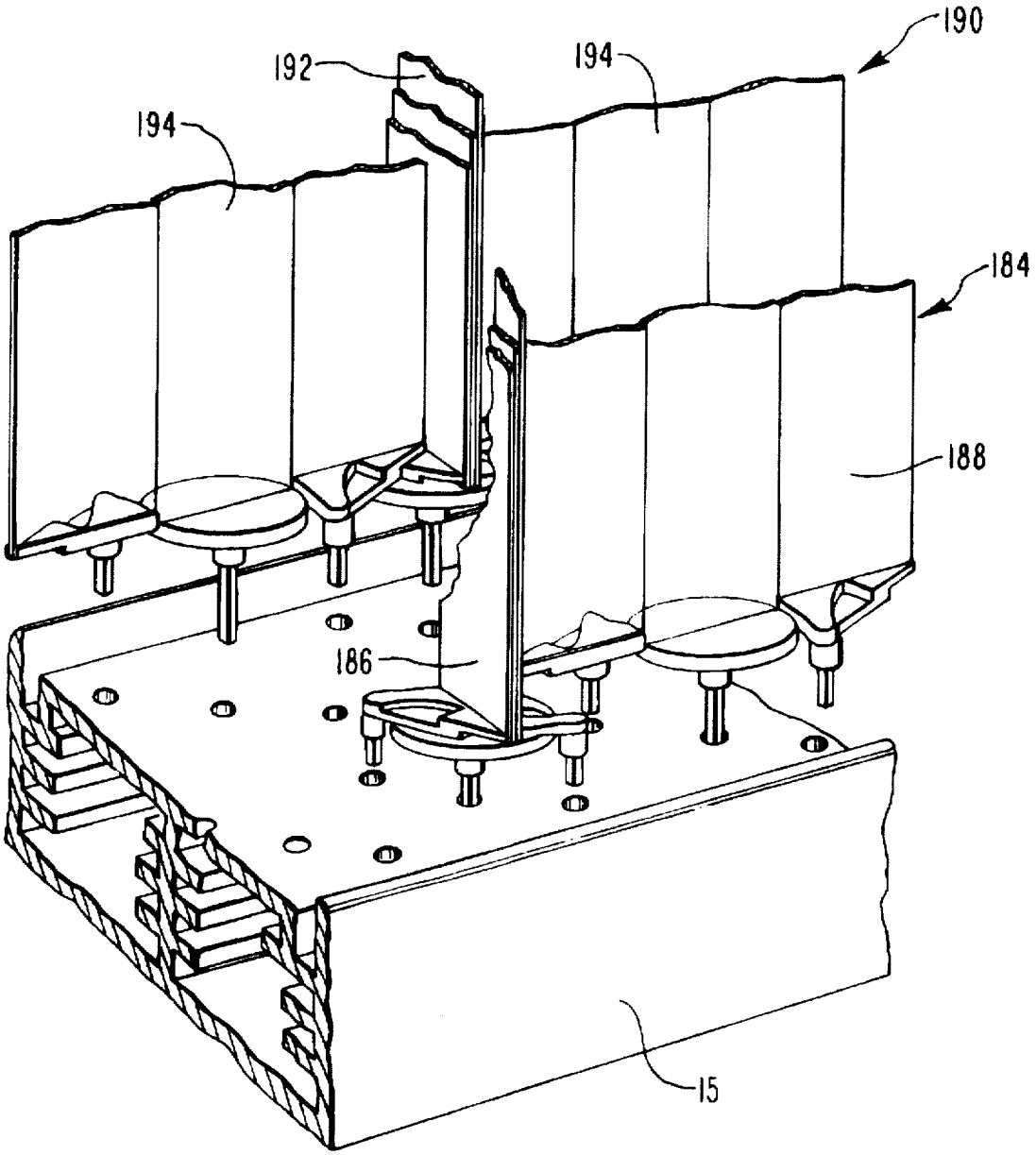
FIG. 6 is perspective view of a blind system with two parallel blind assemblies, each containing two independent panels of slats.

FIG. 6 shows an embodiment of a system with two assemblies in parallel, each assembly containing two independently operating sets of panels of slats A front assembly 184 contains a set C 186 of panels and a set D 188 of panels, while a back assembly 190 contains a set E 192 of panels and a set F 194 of panels. Each of the four sets of panels of slats has a bottom and top opening mechanism, a bottom and top pivot pin, and a bottom and top pivot slide, none of which is shown. Similarly, each system has a actuator mechanism and a bottom to top transfer rod. The fact that the slats, when opened are only ⅓ as wide as traditional slats means that it is possible to put two systems in parallel in the same space occupied by one in a traditional system. This provides a tremendously flexible system for nearly any degree of light control.

Figure 7:
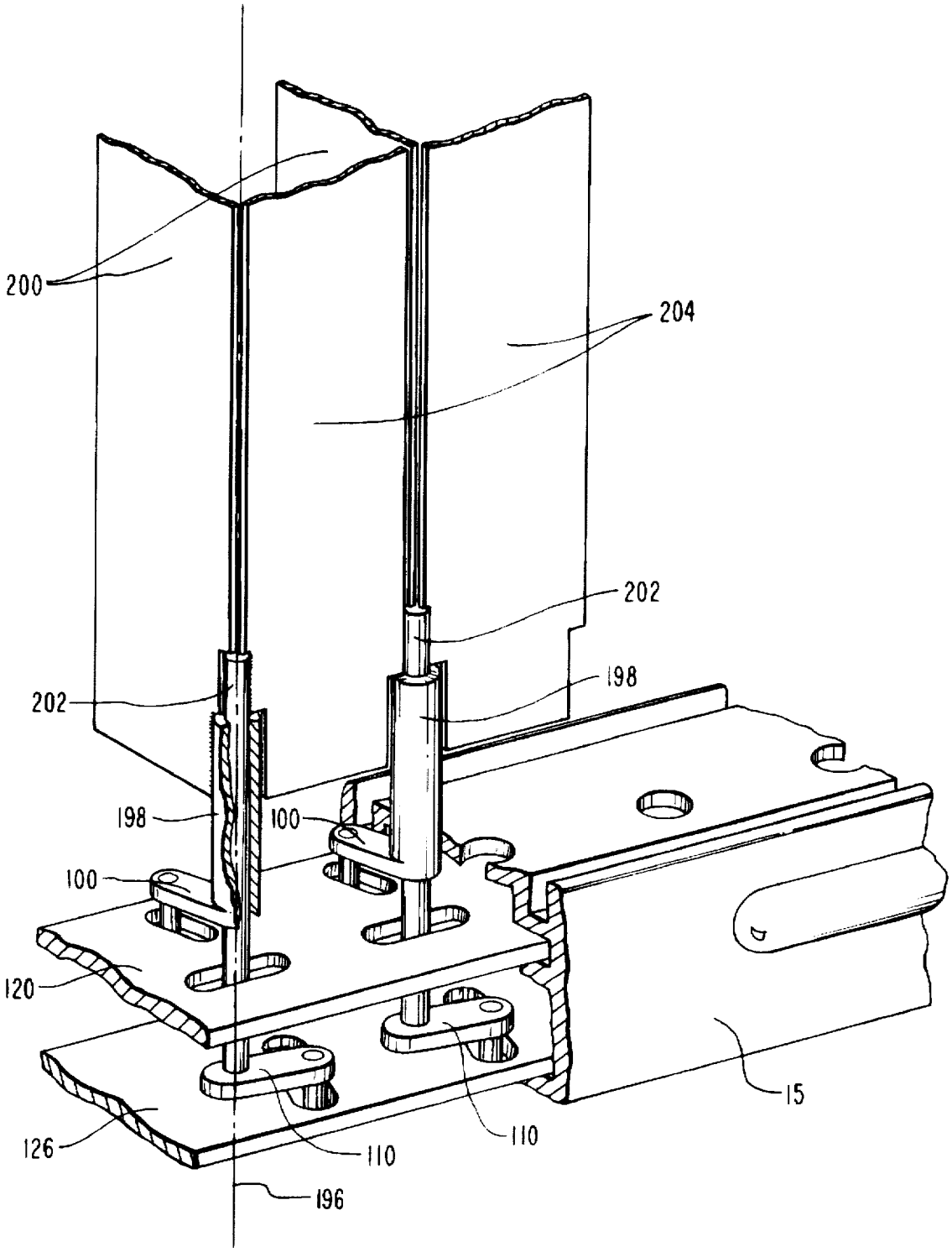
FIG. 7 is a perspective view of a blind system with two sets of single slat panels.

FIG. 7 shows a system with two sets of independently operating single slat panels both of which are in the same plane. This specific embodiment allows the panels to be closed to the front of the system thereby eliminating any obstruction by the opened set of slats that can be seen in FIG. 1. In order to facilitate this, each panel of the two sets of panels of slats are rotated about the same point 196. This is accomplished in this embodiment through the use of concentric cylinders. A bottom outside cylinder 198 and a top outside cylinder, not shown, rotates panels of set A 200 and a bottom inside cylinder 202 and a top inside cylinder, also not shown, rotates panels of set B 204. The bottom outside cylinder is connected to set A's bottom pivot arm 100 and the bottom inside cylinder is connected to set B's bottom pivot arm 110, just as the top outside cylinder is connected to set A's top pivot arm, not shown, the top inside cylinder is connected to set B's top pivot arm. The support holes 69 are not in the center of frame 15, but are instead toward to the front, but they still are arranged in a line. The first bottom pivot slide 120 and the second bottom pivot slide 126 along with the actuator mechanism, not shown, function identically to the systems containing multiple slat systems.

What is claimed and desired to be secured by United States Letters Patent is:

1. A blind system for an opening comprising a first and a second set of a plurality of elongate panels, each panel comprising: left slat, a right slat, and a center slat, said center slat being in contact along one longitudinal edge thereof with the longitudinal edge said left slat, the opposite longitudinal edge of said center slat contacting the longitudinal edge of said right slat, said left slat, said right slat and said center slat being substantially in the same plane; and first and second moving means, attached to each end of said first and second set of panels, respectively for selectively simultaneously rotating every other of said plurality of panels within each respective set between an open position and a closed position independently from the remaining every other of said plurality of panels.

2. A blind system as recited in claim 1, wherein said first and second moving means every other of said plurality of panels is configured to selectively simultaneously rotate each of said plurality of panels about the longitudinal axis of said center slat, said means for selectively simultaneously rotating 3every other of said plurality of panels further being configured to simultaneously rotate both said right slat about the longitudinal edge thereof until said right slat contacts said center slat and said left slat about the longitudinal edge thereof until said left slat contacts said center slat.

3. A blind system as recited in claim 2, wherein:

(a) each of said slats comprising two opposing lateral faces connected by two opposing longitudinal edges, said longitudinal edges being parallel to the longitudinal axis of each of said plurality of panels; and (b) said first moving means and said second moving means being configured to rotate at least one of said slats within each of said panels laterally relative to another of said slats arranged adjacent thereto such that said one of said lateral faces of each of said at least one of said slats is placed in contact with one of said lateral faces of said another of said slats arranged adjacent thereto, thereby increasing the viewable area between each of said sets of panels.

4. A blind system for an opening comprising:

(a) a first set of panels, said first set comprising a plurality of simultaneously operating panels, each of said plurality of panels comprising a set of three slats being arranged as a left slat, a right slat and a center slat, each of said slats having a top end and a bottom end;

(b) a top opening mechanism comprising:

(i) a top center rotator arm connected to said top end of said center slat;

(ii) a top left rotator arm connected to said top end of said left slat; and (iii) a top right rotator arm connected to said top end of said right slat, said top left and said top right rotator arms also being connected to said top center rotator arm;

(iv) a top pivot arm connected to said top center rotator arm with means for rotating said top center rotator arm; and (v) means for pivoting said top pivot arm; and (c) a top blind support structure comprising:

(i) means for support of said left slat, said right slat and said center slat; and (ii) means for containing said top center rotator arm, said top right rotator arm, said top left rotator arm and said top pivot arm with said top center rotator arm for each of said plurality of panels arranged in a top center line;

(d) a bottom opening mechanism comprising:

(i) a bottom center rotator arm connected to said bottom end of said center slat;

(ii) a bottom left rotator arm connected to said bottom end of said left slat; and (iii) a bottom right rotator arm connected to said bottom end of said right slat, said bottom left rotator arm and said bottom right rotator arm also being connected to said bottom center rotator arm;

(iv) a bottom pivot arm connected to said bottom center rotator arm with means for rotating said bottom center rotator arm; and (v) means for pivoting said bottom pivot arm with said top pivot arm;

(e) a bottom blind support structure comprising:

(i) means for support of said left slat, said right slat and said center slat; and (ii) means for containing said bottom center rotator arm, said bottom right rotator arm, said bottom left rotator arm and said bottom pivot arm with said bottom center rotator arm for each of said plurality of panels arranged in a bottom center line.

* * * * *